United States Patent [19]

Ikeda

[11] Patent Number: 4,781,619

[45] Date of Patent: Nov. 1, 1988

[54] CONNECTOR AND METHOD OF CONNECTING WIRES THERETO

[75] Inventor: Tomohiro Ikeda, Kosai, Japan

[73] Assignee: Yazaki Corporation, Japan

[21] Appl. No.: 98,309

[22] Filed: Sep. 18, 1987

[51] Int. Cl.[4] ..... H01R 3/00

[52] U.S. Cl. ..... 439/488; 439/491; 439/744; 29/842; 29/748

[58] Field of Search ..... 439/488, 489, 490, 491, 439/869, 871, 872, 873, 739, 744, 745, 746, 733, 910, 315, 595, 603, 913; 29/842, 857, 863, 876, 739, 741, 745, 747, 748, 749

[56] References Cited

U.S. PATENT DOCUMENTS

| | | | |
|---|---|---|---|
| 3,020,450 | 2/1962 | Shafer | 439/491 |
| 3,569,913 | 3/1971 | Wolff | 439/488 |
| 3,605,068 | 9/1971 | Rayburn | 439/488 |
| 3,989,338 | 11/1976 | Gosser | 439/491 |
| 4,378,648 | 4/1983 | Loof et al. | 40/316 |
| 4,415,765 | 11/1983 | Iwasa et al. | 40/316 |
| 4,636,024 | 1/1987 | Yahata | 439/488 |

*Primary Examiner*—David Pirlot
*Attorney, Agent, or Firm*—Wigman & Cohen

[57] ABSTRACT

In a connector in which a plurality of wire connector terminals are inserted into a connector housing, a first marking is formed at the same position of the wire. Therefore, when a connector terminal is not prefectly inserted into the connector housing, the first marking on the imperfectly inserted terminal is misaligned from the other markings arranged on a parallel line. Further, a second marking is formed on the wire in such a way that the marking distance from the connector terminal increases in incremental steps from one extreme end wire to the other extreme end wire. Therefore, when two connector terminals are not correctly inserted into the connector housing, the second markings on the incorrectly inserted terminals are misaligned from the other markings arranged on an inclined line, thus allowing simple visual inspection of imperfect and incorrect insertions of connector terminals into the connector housing.

5 Claims, 3 Drawing Sheets

CONNECTOR AND METHOD OF CONNECTING WIRES THERETO

BACKGROUND OF THE INVENTION

1. Field of the Invention

The present invention relates to an electric connector having a plurality of wire connecting terminals and a method of connecting wires to the connector.

2. Description of the Prior Art

FIG. 1(A) shows an example of conventional female connector A roughly composed of a connector terminal T and a wire W. The terminal T includes a contact section 1 engageable with a mated male connector terminal (not shown) and a wire connecting section 2 connected to a wire. The wire connecting section 2 has an insulating cover material caulking portion 2*a* and a conductor material caulking portion 2*b*.

The above-mentioned connector terminal A is usually inserted into a cavity 4 of a connector housing 3 made of an insulating material (e.g. resin) and fixed thereto with a hole 7 formed in the contact section 1 engaged with a locking projection 6 provided for the connector housing 3, as shown in FIG. 1(B).

Conventionally, a plurality of connectors $A_1$ to $A_4$ are assembled into a single connector housing 3 having a plurality of cavities 4 to form a multiple female connector as shown in FIG. 1(C). In this case, the connectors A are fitted to the cavities 4 of the multiple connector housing 3, respectively in predetermined positional relationship to each other.

To fix plural connector terminals $A_1$ to $A_4$ to the multiple connector housing 3 in correct mutual positional relationship to each other, the conventional method is as follows: for example, four wires A having four different colors are selected; a first wire $A_1$ having a first color (e.g. red) is fitted to a first housing cavity $4_1$; a second wire $A_2$ having a second color (e.g. blue) is fitted to a second housing cavity $4_2$ and so on; the color arrangement of the wires are checked in accordance with a drawing or a process specification by visual inspection.

In the above-mentioned conventional connector or the method of connecting wires to the connector, it has been impossible to perfectly prevent erroneous connections between wires W and the housing 3, because there exist some cases where the inspector cannot notice the erroneous color arrangement of the wires (referred to as incorrect insertion of the terminal into the housing).

In addition, there exists another problem such that it is impossible to find imperfect engagement between the hole 7 formed in the connector terminal T and the locking projection 6 provided for the connector housing 3 (referred to as imperfect insertion of the terminal T into the housing 3).

SUMMARY OF THE INVENTION

With these problems in mind, therefore, it is the primary object of the present invention to provide a connector and a method of connecting wires to a connector housing which can prevent incorrect insertion and imperfect insertion of connector terminals into a connector housing.

To achieve the above-mentioned object, a connector according to the present invention comprises: (a) a connector housing formed with a plurality of cavities; (b) a plurality of connector terminals each inserted into each of the cavities formed in said connector housing; and (c) a plurality of wires each connected to each of the connector terminals, each of said wires being provided with at least one visible marking formed at a predetermined marking position, to check correct engagement between said connector housing and each of said connector terminals.

When a single marking is formed at a position on each of said wires a same distance away from a predetermined position of said connector terminal, imperfect insertion of said connector terminal into said connector housing can be checked on the basis of misalignment of markings of said wires along a parallel line relative to said connector housing.

When a single marking is formed at a position on each of said wires in such a way that the marking distance from a predetermined position of each of said connector terminals increases in incremental steps from the wire connected to a connector terminal inserted into one extreme end cavity of said connector housing to that inserted into the other extreme end cavity of said connector housing, incorrect insertion of said connector terminals into said connector housing can be checked on the basis of misalignment of markings of said wires along an inclination line relative to said connector housing.

The marking is formed on said wire by applying a color paint onto said wire or by winding a color adhesive tape around said wire.

To achieve the above-mentioned object, a method of connecting wires to a connector according to the present invention comprises the following steps of: (a) stripping a part of insulating material from an end of each of wires to expose a conductor thereof; (b) caulking each of the stripped conductor to each of connector terminals; (c) forming a first visible marking at a position on each of the wires a predetermined same distance away from a predetermined position of each of the connector terminals; (d) inserting a plurality of connector terminals to each of which the wire having the first visible marking is connected into a connector housing; and (e) checking imperfect insertion of the connector terminals into the connector housing on the basis of misalignment of the first markings of the wires along a parallel line relative to said connector housing.

Further, when a second visible marking is formed at a position on each of the wires in such a way that a marking distance from a predetermined position of each of the connector terminals increases in incremental steps from the wire connected to a connector terminal inserted into one extreme end of the connector housing to that inserted into the other extreme end of the connector housing, incorrect insertion of the connector terminals into the connector housing can be checked on the basis of misalignment of the second markings of said wires along an inclination line relative to the connector housing.

Further, the first and second visible markings can be formed on the wire simultaneously when the wire is caulked to the connector terminal.

BRIEF DESCRIPTION OF THE DRAWINGS

The features and advantages of the connector and the method of connecting wires to the connector according to the present invention will be more clearly appreciated from the following description of the invention taken in conjunction with the accompanying drawings in which like reference numerals and symbols designate the same or similar elements or sections throughout the figures thereof and in which:

FIG. 2(B)-2 is a cross-sectional view showing the connector of the present invention, which illustrates an imperfect insertion;

DETAILED DESCRIPTION OF THE PREFERRED EMBODIMENTS

Figure 2A:
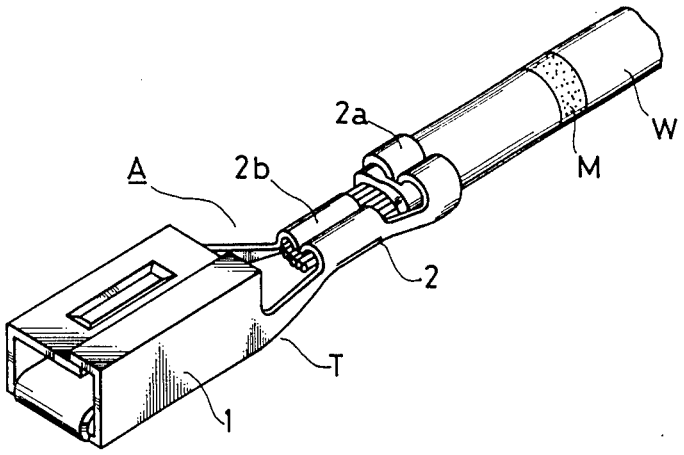
FIG. 2(A) is a perspective view showing a connector terminal of the present invention.

FIG. 2(A) shows an example of connector A of the present invention, in which the feature thereof is to apply a visible marking M on a wire W at a position a predetermined distance away from a predetermined position of the connector terminal T.

Figure 1A:
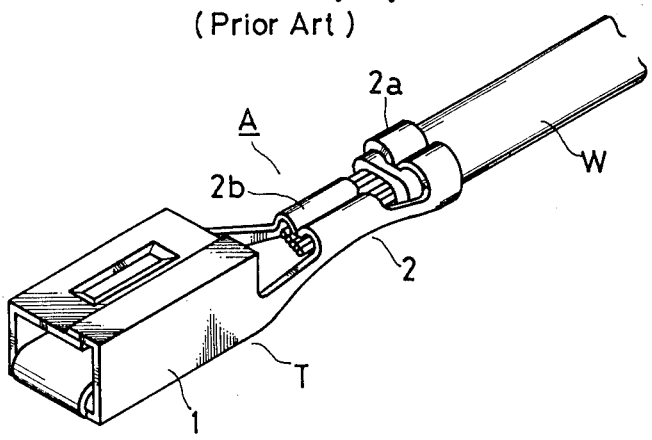
FIG.1(A) (Prior Art)
FIG. 1(A) is a perspective view showing an example of prior-art female connector terminal.
Figure 1B:
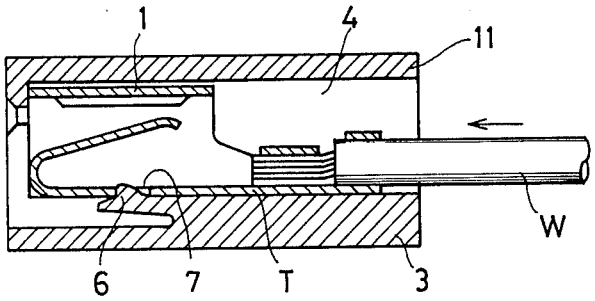
FIG.1(B) (Prior Art)
FIG. 1(B) is a cross-sectional view showing the prior-art connector.
Figure 1C:
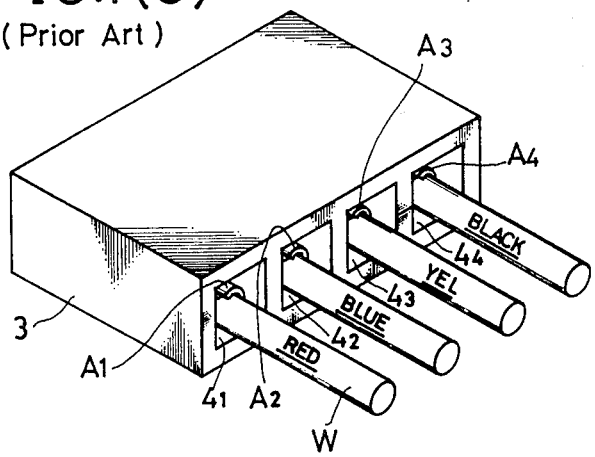
FIG.1(C) (Prior Art)
FIG. 1(C) is a perspective view showing a prior-art multiple connector.

The connector terminal T shown in FIG. 2(A) is the same in structure as the prior-art one shown in FIG. 1(A) except the marking M. Therefore, the references have been retained for the same parts or elements which have the same functions, without repeating the description thereof.

Figures 1, 2B:
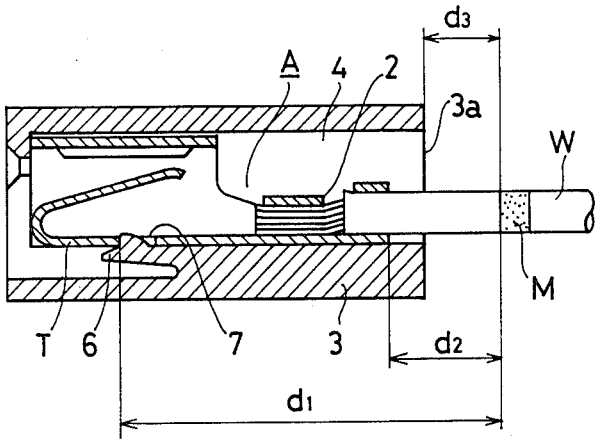
FIG. 2(B)-1 is a cross-sectional view showing the connector of the present invention, which illustrates a perfect insertion.

As depicted in FIG. 2(B)-1, the position at which the marking M is applied is determined a predetermined distance away from a predetermined position of the connector A or the connector terminal T, for instance, such as $d_1$ rearward away from the frontward end of the hole 7 formed in the connector terminal T, $d_2$ rearward away from the rearward end of the wire connecting section 2, or $d_3$ rearward away from the rearward end 3*a* of the housing 3 when the connector A is perfectly engaged with the terminal housing 3.

The marking M can be formed by applying a distinguishable color point different from the wire surface color or by winding a colored adhesive tape around the wire A. Further, it is preferable to additionally incorporate a marking mechanism with a caulking tool for fastening the wire to the wire connecting section 2. The marking is formed after the wire W has been cut off to a predetermined length and the insulating cover has been partially stripped off. In other words, the marking M can be formed around the wire W simultaneously when the wire W is fixed to the connector terminal T.

FIG. 2(B)-1 shows a state where the wire W and connector terminal T are perfectly inserted into the connector housing 3 (i.e. the locking projection 6 is perfectly engaged with the hole 7). In these conditions, the marking M is positioned $d_3$ away from the rearward end 3*a* of the housing 3.

Figures 2, 2B:
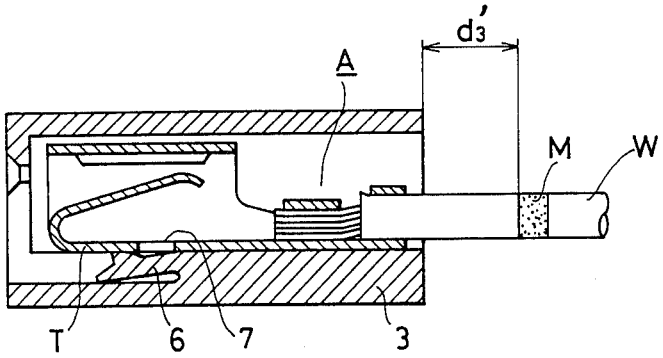

FIG. 2(B)-2 shows a state where the wire W and connector terminal section T are imperfectly inserted into the connector housing 3. (i.e. the locking projection 6 is not engaged with the hole 7) In these conditions, the marking M is positioned a distance $d_3'$ ($>d_3$) away from the rearward end 3*a* of the housing 3. The difference between $d_3$ and $d_3'$ can be distinguished by visual check or measurement with a scale, therefore it is possible to easily check the presence or absence of imperfect insertion of the wire W into the connector housing 3.

Figure 3A:
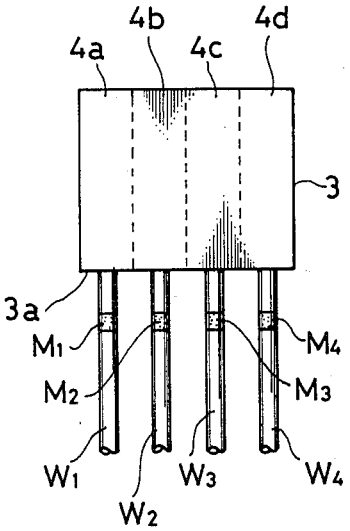
FIG. 3(A) is a top view showing a connector of a first embodiment of the present invention, which illustrates a perfect insertion.

FIG. 3(A) shows a state where a plurality of wires $W_1$ to $W_4$ each having a marking $M_i$ formed the same distance away from the end 3*a* of the housing 3 are perfectly inserted into the cavities 4*a* to 4*d* of the connector housing 3. In these conditions, all the markings $M_1$ to $M_4$ are aligned along a parallel line relative to the connector housing 3.

Figure 3B:
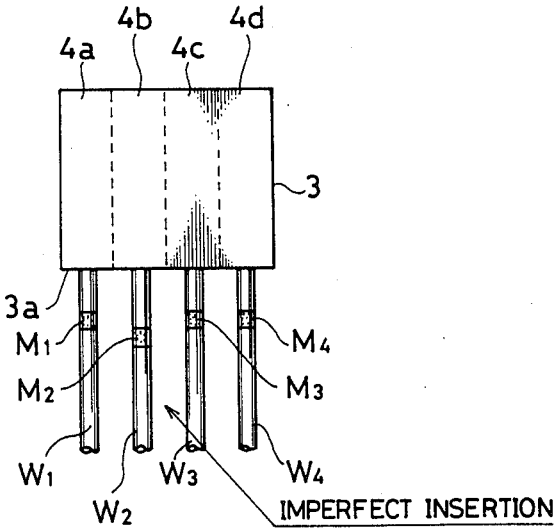
FIG. 3(B) is a top view showing the same connector of the first embodiment, which illustrates an imperfect insertion.

FIG. 3(B) shows a state where a second wire $W_2$ is imperfectly inserted into the cavity 4*b* of the connector housing 3 and other wires $W_1$, $W_3$ and $W_4$ are perfectly inserted into the cavities 4*a*, 4*c* and 4*d* of the connector housing 3. In these conditions, only the marking $M_2$ is misaligned from the other marking positions, thus it being possible to readily find a wire terminal imperfectly inserted into the housing 3 by visual inspection.

As described above, when a single marking M is applied to each wire A, it is possible to easily check imperfect insertion of the wire or the terminal T.

Figure 4A:
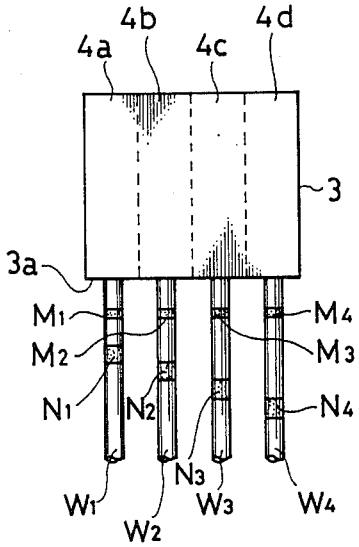
FIG. 4(A) is a top view showing a connector of a second embodiment of the present invention, which illustrates a correct and perfect insertion.

FIGS. 4(A) and (B) show a case where two markings $M_i$ and $N_i$ are applied to each wire. In this embodiment, it is possible to further check incorrect insertion of connector terminals in addition to checking of imperfect insertion of connector terminals. In more detail, the two markings $M_i$ and $N_i$ are formed on each wire in such a way that a distance between two markings $M_i$ and $N_i$ are increased in incremental steps from the first wire $W_1$ connected to the first cavity 4*a* to the fourth wire $W_4$ connected to the fourth cavity 4*d*.

FIG. 4(A) shows a state where a plurality of wires $W_1$ to $W_4$ each having two markings $M_i$ formed the same distance away from the end 3*a* of the housing 3 and $N_i$ formed different distances away from the end 3*a* of the housing 3 are perfectly inserted into the cavities 4*a* to 4*d* of the connector housing 3 in correct positional relationship to each other. In these conditions, all the markings $M_1$ to $M_4$ are arranged along a parallel line relative to the connector housing 3, while all the markings $N_1$ to $N_4$ are arranged along an inclined line relative to the connector housing 3 (right side down in FIG. 4A).

Figure 4B:
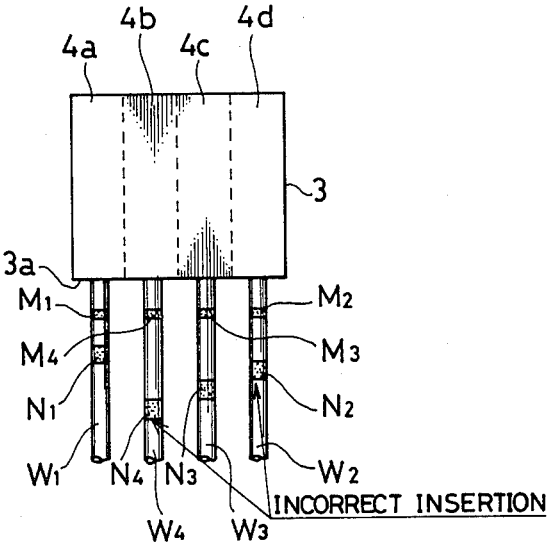
FIG. 4(B) is a top view showing the same connector of the second embodiment, which illustrates incorrect insertions.

FIG. 4(B) shows a state where the second and fourth wires $W_2$ and $W_4$ are perfectly inserted into the cavities 4*b* and 4*d* but incorrectly inserted thereinto ($W_2$ is taken for $W_4$ or vice versa). In these conditions, all the markings $M_1$ to $M_4$ are arranged in parallel to the terminal housing 3, while all the markings $N_1$ to $N_4$ are not arranged along an inclined line.

As described above, in the second embodiment shown in FIGS. 4(A) and 4(B), it is possible to check imperfect insertion of the connector terminals on the basis of a parallel arrangement of the markings $M_i$ formed the same distance away from the housing 3 and simultaneously in correct insertion of the connector terminals or the basis of an inclined arrangement of the markings $N_i$ formed different distances away from the housing 3.

As described above, in the present invention, it is possible to readily check imperfect and incorrect insertions of connector terminals into a connector housing by simply applying markings on the wires.

In the above description, a female connector is described by way of example. However, the present invention can of course be applied to a male connector or other connectors of any different types.

What is claimed is:

1. A connector comprising:

(a) a connector housing formed with a plurality of cavities;

(b) a plurality of connector terminals each inserted into one of the cavities formed in said connector housing; and (c) a plurality of wires each connected to one of the connector terminals, each of said wires being provided with a single marking formed at a position on each of said wires a same distance away from a predetermined position of said connector terminal, to check imperfect insertion of said connector terminal into said connector housing on the basis of misalignment of markings of said wires along a parallel line relative to said connector housing.

2. The connector of claim 1, wherein a second marking is formed at a position on each of said wires in such a way that the marking distance from a predetermined position of each of said connector terminals increases in incremental steps from the wire connected to a connector terminal inserted into one extreme end cavity of said connector housing to that inserted into the other extreme end cavity of said connector housing, to check incorrect insertion of said connector terminals into said connector housing on the basis of misalignment of markings of said wires along an inclination line relative to said connector housing.

3. A method of connecting wires to a connector, which comprises the following steps of:

(a) stripping a part of insulating material from an end of each of wires to expose a conductor thereof;

(b) caulking each of the stripped conductors to a connector terminal;

(c) forming a first visible marking at a position on each of the wires a predetermined same distance away from a predetermined position of each of the connector terminals;

(d) inserting a plurality of connector terminals to each of which the wire having the first visible marking is connected into a connector housing; and (e) checking imperfect insertion of the connector terminals into the connector housing on the basis of misalignment of the first markings of the wires along a parallel line relative to said connector housing.

4. The method of claim 3, which further comprises the following steps of:

(a) forming a second visible marking at a position on each of the wires in such a way that a marking distance from a predetermined position of each of the connector terminals increases in incremental steps from the wire connected to a connector terminal inserted into one extreme end of the connector housing to that inserted into the other extreme end of the connector housing; and (b) checking incorrect insertion of the connector terminals into the connector housing on the basis of misalignment of the second markings of said wires along an inclination line relative to the connector housing.

5. The method of claim 4, wherein the second visible marking is formed on the wire simultaneously when the wire is caulked to the connector terminal.

* * * * *